US005144107A

United States Patent [19]

Peleg

[11] Patent Number: 5,144,107

[45] Date of Patent: Sep. 1, 1992

[54] MICROWAVE SUSCEPTOR SHEET STOCK WITH HEAT CONTROL

[75] Inventor: Yigal Peleg, Solon, Ohio

[73] Assignee: The Stouffer Corporation, Solon, Ohio

[21] Appl. No.: 508,256

[22] Filed: Apr. 11, 1990

[51] Int. Cl.[5] ..... H05B 6/80

[52] U.S. Cl. ..... 219/10.55 E; 219/10.55 F; 426/107; 426/234; 426/243; 99/DIG. 14

[58] Field of Search ..... 219/10.55 E, 10.55 F; 426/107, 109, 111, 113, 234, 241, 243; 126/390; 99/DIG. 14

[56] References Cited

U.S. PATENT DOCUMENTS

| | | | |
|---|---|---|---|
| 2,600,566 | 6/1952 | Moffett | 99/221 |
| 2,830,162 | 4/1958 | Copson et al. | 219/10.41 |
| 3,079,913 | 3/1963 | Nelson | 219/10.55 E X |
| 3,302,632 | 2/1967 | Fichtner | 126/390 |
| 3,591,751 | 7/1971 | Goltsos | 219/10.55 |
| 3,701,872 | 10/1972 | Levinson | 219/10.55 |
| 3,777,099 | 12/1973 | Levinson | 219/10.55 |
| 3,783,220 | 1/1974 | Tanizaki | 219/10.55 |
| 3,854,023 | 12/1974 | Levinson | 219/10.55 |
| 3,865,301 | 2/1975 | Pothier | 229/14 R |
| 3,922,452 | 11/1975 | Forker, Jr. et al. | 428/35 |
| 3,946,188 | 3/1976 | Derby | 219/10.55 |
| 3,965,323 | 6/1976 | Forker, Jr. et al. | 219/10.55 |
| 4,147,836 | 4/1979 | Middleton et al. | 428/481 |
| 4,190,757 | 2/1980 | Turpin | 219/10.55 |
| 4,230,924 | 10/1980 | Brastad et al, | 219/10.55 |
| 4,266,108 | 5/1981 | Anderson et al. | 219/10.55 |
| 4,267,420 | 5/1981 | Brastad | 219/10.55 |
| 4,283,427 | 8/1981 | Winters et al. | 426/107 |
| 4,351,997 | 9/1982 | Mattisson | 219/10.55 |
| 4,398,077 | 8/1983 | Freedman et al. | 219/10.55 |
| 4,434,197 | 2/1984 | Petriello et al. | 427/407.1 |
| 4,453,066 | 6/1984 | Mori | 219/10.55 |
| 4,454,403 | 6/1984 | Teich et al. | 219/10.55 |
| 4,518,651 | 5/1985 | Wolfe, Jr. | 428/308.8 |
| 4,520,251 | 5/1985 | Yokozeki | 219/10.55 |
| 4,555,605 | 11/1985 | Brown et al. | 219/10.55 |
| 4,567,341 | 1/1986 | Brown | 219/10.55 |
| 4,590,349 | 5/1986 | Brown et al. | 219/10.55 |
| 4,592,914 | 6/1986 | Kuchenbecker | 426/107 |
| 4,594,492 | 6/1986 | Maroszek | 219/10.55 |
| 4,612,431 | 9/1986 | Brown et al. | 219/10.55 |
| 4,626,641 | 12/1986 | Brown | 219/10.55 |
| 4,641,005 | 2/1987 | Seiferth | 219/10.55 |
| 4,656,325 | 4/1987 | Keefer | 219/10.55 |
| 4,661,671 | 4/1987 | Maroszek | 219/10.55 |
| 4,663,506 | 5/1987 | Bowen et al. | 219/10.55 |
| 4,689,458 | 8/1987 | Levendusky et al. | 219/10.55 |
| 4,701,585 | 10/1987 | Stewart | 219/10.55 |
| 4,703,148 | 10/1987 | Mikulski et al. | 219/10.55 |
| 4,705,929 | 11/1987 | Atkinson | 219/10.55 |
| 4,713,510 | 12/1987 | Quick et al. | 219/10.55 |
| 4,775,771 | 10/1988 | Pawlowski | 219/10.55 |
| 4,777,053 | 10/1988 | Tobelmann et al. | 426/107 |
| 4,780,587 | 10/1988 | Brown | 219/10.55 |
| 4,825,025 | 4/1989 | Seiferth | 219/10.55 |
| 4,891,482 | 1/1990 | Jaeger et al. | 219/10.55 |
| 4,940,867 | 7/1990 | Peleg | 219/10.55 E |
| 4,985,606 | 1/1991 | Faller | 219/10.55 E |
| 5,041,325 | 8/1991 | Larson et al. | 219/10.55 E |
| 5,049,714 | 9/1991 | Beresniewicz et al. | 219/10.55 E |

*Primary Examiner*—Philip H. Leung
*Attorney, Agent, or Firm*—Body, Vickers & Daniels

[57] ABSTRACT

In a blankable, foldable microwave reactive heat susceptor sheet stock of the type having two generally parallel surfaces and comprising a thin paperboard sheet with a laminated, continuous, microwave reactive layer including a microwave permeable support film with a microwave reactive layer including a microwave permeable support film with a microwave reactive stratum, there is provided an improvement comprising a graybody layer with an absorptivity over about 0.50 and microwave permeable with the graybody layer being applied coterminously with at least a portion of the parallel surfaces so that heat created by the interactive stratum will be absorbed and available from the graybody layer.

44 Claims, 6 Drawing Sheets

$R_T = 5.670 \times 10^{-12} T^4$ (BLACKBODY)

$\alpha R_T = \epsilon R_T$ (GRAYBODY)

$\alpha = \epsilon \cong .97 - .20$@300°F $R_T = 5.670 \times 10^{-12} T^4$ (BLACKBODY)

$\alpha R_T = \epsilon R_T$ (GRAYBODY)

$\alpha = \epsilon \cong .97 - .20$ @ 300°F

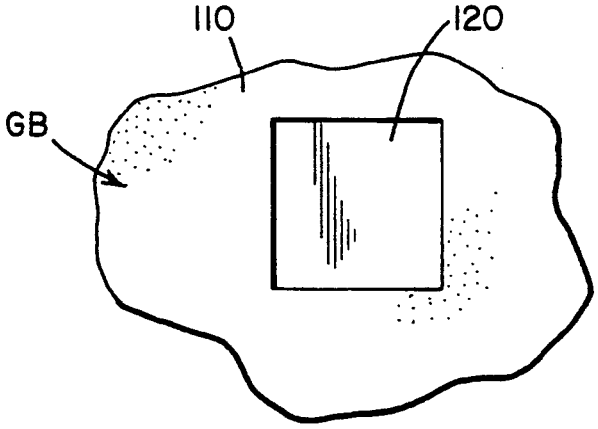
FIG. 12
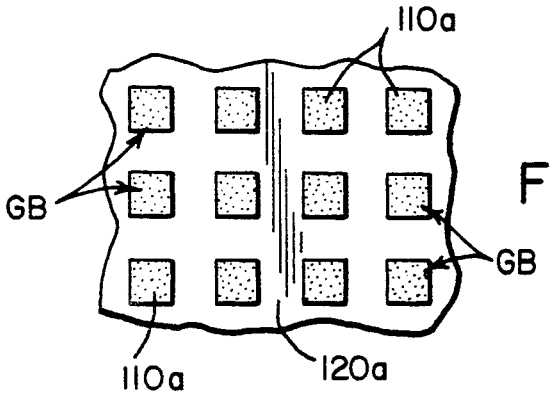
FIG. 13
FIG. 14
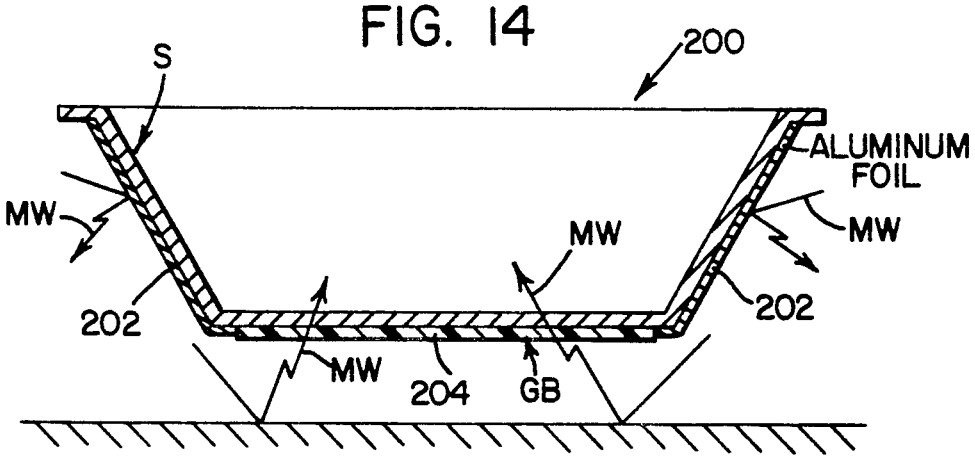

10
12
14
20
MW
P1
32
22
40
P2
Pn

MICROWAVE SUSCEPTOR SHEET STOCK WITH HEAT CONTROL

This invention relates to the art of microwave reactive heat susceptor sheet stock and more particularly to an improved susceptor sheet stock with heat control means allowing selective manipulation of the available heat from the sheet stock.

INCORPORATION BY REFERENCE

Seiferth U.S. Pat. No. 4,641,005 is incorporated by reference herein as relating to a blankable, foldable microwave reactive heat susceptor sheet stock of the type having two generally parallel surfaces and comprising a thin paperboard sheet with a laminated, coterminous, microwave reactive layer including a microwave permeable support film with a microwave reactive stratum. This type of sheet material is commonly employed for forming cooking utensils, such as heating sleeves for frozen foods, such as frozen French Bread pizza. This patent is incorporated by reference so that it is not necessary to explain the details of the sheet stock susceptor material to which the present invention is directed.

Also incorporated by reference herein as background information is Jaeger U.S. Pat. No. 4,891,482 relating to the use of sheet stock material to which the present invention is directed for forming a heating sleeve to be employed in reconstituting a frozen food, such as frozen French Bread pizza. The disclosure of this Jaeger patent, together with the Seiferth patent disclosure, indicates a common type of thin paperboard heat susceptor sheet provided in packages of frozen foods. This sheet stock is formed into a cooking utensil and then used for reconstituting the frozen food by the ultimate consumer.

The present invention is particularly applicable for reconstituting frozen food, such as slices of French Bread pizza and it will be described with particular reference thereto; however, the invention has much broader applications and may be used for utensils to reconstitute various frozen foods, or heat a variety of food products, or it can be used for other consumer and/or industrial heating applications wherein a thin heat susceptor sheet is employed for the purposes of directly using microwave converted heat to heat by conduction or radiation.

In the convenience food industry, such as frozen foods, a tremendous amount of effort is devoted to providing an appropriate utensil or system to reconstitute the frozen food after it has been purchased from the retail outlet. A great number of systems and utensils have been suggested and employed for the purposes of reconstituting such frozen food. In recent years, the most commercially viable approach has been to employ a thin paperboard type heat susceptor sheet stock which is essentially a thin paperboard onto which is adhered a microwave reactive sheet. This reactive sheet is a plastic film with a vacuum deposited microwave reactive stratum generally in the form of vacuum deposited elemental aluminum. The aluminum is captured between protective film and the paperboard so that the film itself engages the food substance to be reconstituted by a system employing this heat susceptor sheet stock. As microwave energy is passed through the reactive stratum, the stratum is heated by eddy current heating through the flow of induced current. This eddy current heating raises the temperature of the stratum to create a heat source whereby the created heat can be directly conducted to the food substance in engagement with the protective plastic film. These systems have either involved use of the sheet stock as part of the package employed to transport and sell the food item or as a blank in the package that is formed into a separate cooking utensil. For instance an unassembled unit, such as a platform or sleeve can be collapsed and placed in the food package in a generally flat condition. The consumer then forms the unit into a heating utensil for use in a microwave oven.

In all instances, the thin paperboard based heat susceptor sheet stock has a deposited amount of aluminum which will create the desired heating of the reactive layer or stratum as microwave energy is passed through the stratum. The amount of heat created by microwave energy passing through the stratum is controlled by the amount of deposition, which is often measured by ohms/in on the surface of the stratum. As more aluminum is deposited, the surface resistivity decreases. Consequently, it is generally essential to control the deposition rate to obtain the desired heating in the receptacle or heating system for the food product. The modulation of the surface resistivity to obtain the desired amount of heat may not be conducive to the heating needed at all areas of the utensil formed to heat the food produce. For instance, as is well known in the art, the heating effect to create a crisp crust on a food product, such as French Bread pizza, requires a higher temperature. This higher temperature may not be obtainable by the normal constraints necessary for effective and efficient heating in the reactive stratum. Consequently, many arrangements have been offered for causing browning of the bottom bread crust of pizza, while allowing the necessary heating for reconstituting the remainder of the pizza during a single microwave heating cycle. One of the most successful approaches is that described in Jaeger U.S. Pat. No. 4,891,492 wherein the bottom portion of the heating sleeve is provided with two separate and distinct layers of the susceptor sheet stock. By using these separate layers at the lower portion of the heating sleeve, a greater amount of heat is created at the crust area of the pizza. This has proven extremely successful and is commercial implemented.

The use of two layers of sheet stock in a sleeve for reconstituting French Bread pizza, although commercial viable, has presented two known limitations. First, the temperature is still somewhat controlled by the needed deposition in the stratum for efficient microwave heat conversion. This factor restricts the flexibility of the desired heating when using two or more layers of the susceptor sheet stock. In addition, a substantial amount of sheet stock is needed when forming a sleeve having two separate layers. The sheet stock is expensive material and adds to the total cost of the food product, which product is in the highly competitive convenience food industry. Slight package savings can be extremely important in the overall commerical acceptability of such a product. In addition, this type of prior commercial heating utensil for frozen food is transported in the frozen food package and requires a substantial amount of head room. At least three layers of sheet stock are required between the frozen food product and the inner surface of the package itself.

In view of these basically economic considerations, there has been a substantial effort to further develop improvements in the system used to reconstitute frozen foods, such as slices of French Bread pizza and other pizza type items having both a bottom crust which requires high crisping temperature and a body which simultaneously requires substantial total heat from the microwave energy for a single cycle reconstitution. There is a need for a relatively inexpensive, effective heat utensil formed from sheet stock for reconstituting frozen foods, which requires a minimum amount of the sheet stock and still can produce the desired high temperature heating of the bottom crust and the necessary microwave heating for the remainder of the food item. The inexpensive sheet stock utensil or appliance must assure that the food item will have a brown, crisp crust at the same time it has a reconstituted body portion.

THE PRESENT INVENTION

The present invention relates to an improvement in the microwave reactive heat susceptor sheet stock of the type having a paperboard base and described in many prior patents, such as Seiferth U.S. Pat. No. 4,641,005 and Jaeger U.S. Pat. No. 4,891,482. By using this improvement, there can be a substantial reduction in the needed amount of microwave reactive heat susceptor sheet stock needed for the heating utensil or appliance that is employed to reconstitute frozen food items, such as frozen French Bread pizza. In addition, this improvement allows for a crisping, browning effect on the lower bread crust, without the necessity of an additional sheet stock layer or other modifications of the sheet stock. By using the present invention, it has been found that a heating utensil or appliance employing the present invention can be used for a number of reconstitution cycles so that a single heating utensil can be supplied with a package containing two or more slices of French Bread pizza slices. In the past, it has been conventional wisdom to employ separate and distinct heating utensils for each slice of pizza provided in a single package. Thus, if two slices are provided, two separate and distinct heating utensils or applicances were supplied. By using the present invention, an appliance can be provided for each slice or a single heating unit can be supplied to the customer. A single unit results in a further reduction in the cost of the product. No matter how many heating units are provided to the customer, each unit uses a lesser amount of sheet susceptor stock is required for each heating utensil.

In accordance with the present invention there is provided an improvement in a blankable, foldable microwave reactive heat susceptor sheet stock of the type having two generally parallel surfaces and comprising a thin paperboard sheet with a laminated, coterminous*, microwave reactive layer including a microwave permeable support film with a microwave reactive stratum. The improvement comprises a graybody layer with a high absorptivity and microwave permeable. This layer, thus, allows free passage of microwave energy. The graybody layer is applied coterminously with at least a portion of the parallel surfaces in the sheet stock. The invention is in the use of a layer of high heat absorbing material applied by coating, laminating, deposition, i.e. printing or photographic, etc. The heat from the microwave reactive stratum is absorbed by the absorbing material. Normally the material is black and approaches the ideal blackbody with an absorptivity of 1.0. Thus, the preferred embodiment uses a black layer with an absorptivity over 0.90. This is more technically defined as a graybody; however, a graybody has a wide variety of absorptivity. To illustrate that the invention uses high absorptivity, the graybody layer of the present invention is defined as having a high absorptivity, this can be defined as the general range of 0.50–0.97. This resistivity approaches a blackbody (1.0) at the high range of resistivity. A "graybody" is generally known as a high absorptivity substance which can approach the unobtainable black body status. Such layer can be provided by printing, coating, or laminating. Application of the graybody layer can be on the surface of the various constituent portions of the susceptor sheet stock. For instance, it can be on the outside, exposed surface of the paperboard. It can be on the inside, hidden surface of the paperboard. Further, it can be applied to the protective plastic film or over the aluminum microwave reactive stratum. No matter how the graybody layer is applied to the sheet stock or where it is located, it still has the same heat absorbing, thermodynamic characteristic. Heat from the parallel, closely spaced microwave reactive material layer is absorbed by the graybody layer in the area of the sheet stock containing the absorbing layer. Consequently, the graybody layer provides a heat sink to absorb and hold the heat created by the parallel microwave interactive stratum. The stratum itself has a low absorptivity and high reflectivity. Thus, the stratum can not form an efficient heat sink. Further, the reactive layer can not form a heat sink because it is so thin, being in the neighborhood of substantially less than about 1 micron in thickness. In accordance with the invention, there is an interaction between the heat generated in the reactive stratum and the parallel graybody layer added to the standard sheet stock. There is a direct and immediate transfer of heat to the graybody. This absorption rate is greater for layers with high absorptivity. For instance, if the graybody has a black color such as carbon black or soot, the absorptivity may approach 0.97. As the color changes to shades of gray and possibly blue, a lesser amount of heat is absorbed due to a lowering of the absorptivity. The lower limit of absorptivity is probably in the general range of 0.50 found in two coats of linseed oil. The actual value of the absorptivity can be varied as desired, as long as the inventive concept of the invention is employed. The inventive concept is the interaction of a closely spaced microwave reactive layer and a parallel graybody layer. The interactive layer transfers heat immediately to the graybody layer which holds the heat for the purpose of creating both a high temperature in the neighborhood of 300°–350° at the interface between the thin sheet stock forming the heat susceptor and the food engaged by the susceptor sheet stock and high temperature heat energy to the heated food product.

In the past, the sheet stock appliances were usually modified to give a high browning temperature. The present invention accomplishes that objective without advancing the temperature much above 300° F. In addition, more heat energy is provided to, and concentrated in, the bread area.

In summary, the present invention relates to the application of a graybody layer onto a standard heat susceptor sheet stock. This layer can be selectively applied adjacent the portion of the sheet stock adjacent the bottom of the pizza or other bread item for the purposes of causing efficient browning and crisping of the bread surface without high surface temperatures. The graybody layer can have a preselected pattern, or can be located in only certain areas of the sheet stock, for controlling the desired heating effect in an appliance made from a sheet stock using the invention.

In accordance with another aspect of the present invention, there is provided a heating utensil or appliance employing the present invention wherein the heating utensil is essentially a lower platform formed from a microwave susceptor sheet stock wherein a graybody layer is applied on the lower surface of the platform. This graybody then absorbs the heat from the reactive layer which is parallel and just above it for the purposes of absorbing the heat and providing the heat directly to the lower surface of the food item on the platform. The graybody layer is permeable to microwave energy so that microwave freely passes through the layer; consequently, the layer absorbs and holds the heat, but does not in any way interfere with the microwave energy passing through the reactive stratum. In this fashion, the stratum can have the desired surface resistivity to cause the desired heating while the parallel, closely spaced graybody layer can absorb, retain and transfer high levels of heat energy to the food item. Thus, reactive material can have parameters needed for efficient microwave heating without concern for the browning effect which is created by the separate and distinct, parallel microwave permeable, high absorptivity graybody layer.

The primary object of the present invention is the provision of an improvement in a standard microwave reactive heat susceptor sheet stock, which improvement provide a high temperature browning or crisping action without the necessity of modifying the susceptor sheet stock itself.

Another object of the present invention is the provision of a graybody layer on a standard microwave reactive heat susceptor sheet stock to absorb heat in a selected area by heat transfer from the reactive stratum to the parallel, closely spaced graybody so that the heat energy is captured in the layer and immediately transferred to the food product.

Yet another object of the present invention is the provision of an improved microwave reactive heat susceptor sheet stock which can be produced in accordance with standard practice, but which is modified in certain areas to change the heating effect of those areas by employing a graybody having a selected area pattern or other physical condition to control the desired heating adjacent the portion of the sheet stock having the graybody layer.

Still a further object of the present invention is the provision of a method of heating a food substance, such as frozen slices of French Bread Pizza, which is accomplished by a relatively inexpensive heating utensil or appliance requiring a minimum of susceptor sheet stock and still obtaining the necessary high temperature for crisping and browning the lower surface of the food product and transfer of heat energy to this surface.

These and other objects and advantages will become apparent from the following description taken with the accompanying drawings.

BRIEF DESCRIPTION OF THE DRAWINGS

The following drawings are included:

FIGS. 10–13 are enlarged schematic views showing several pattern concepts that can be employed in accordance with the present invention;

FIG. 14 is a cross-sectional view of a pot pie heating utensil employing the present invention;

PREFERRED EMBODIMENTS

Figure 1:
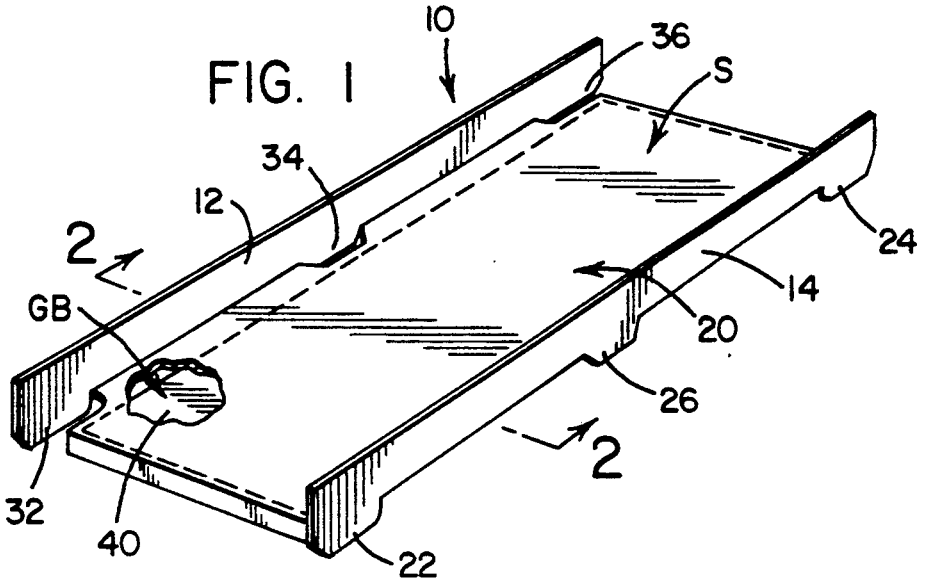
FIG. 1 is a pictorial view of a heating utensil employing the present invention.
Figure 2:
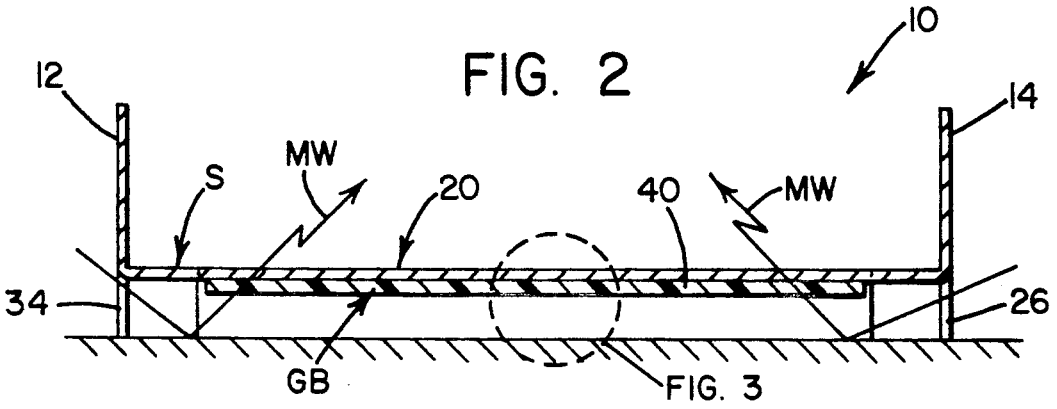
FIG. 2 is a further enlarged cross-sectional view taken generally along line 2—2 of FIG. 1.
Figure 3:
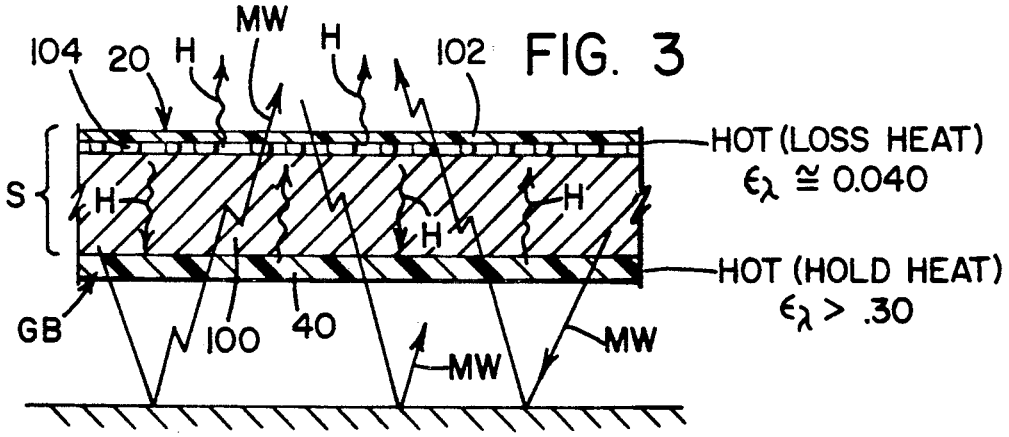
FIG. 3 is an enlarged partial cross-sectional view taken from the encircled area of FIG. 2 and containing certain relationships relating to absorptivity of a graybody.

Referring now to the drawings wherein the showings are for the purpose of illustrating preferred embodiment of the invention only, and not for the purpose of limiting same, FIGS. 1–3 show a heating utensil or appliance 10 for reconstituting slices of pizza. This utensil is formed from a single blank of foldable microwave reactive heat susceptor sheet stock S and includes parallel folded sides 12, 14 on the opposite edges of a lower support portion or platform 20 onto which the bread or crust portion of the pizza slice is positioned for microwave reconstitution in an appropriate domestic microwave oven. When blank S is folded to form sides 12, 14, legs 22, 24 and 26 protrude from side 14 and legs 32, 34 and 36 protrude from side 12. The upper portion of the pizza slice which contains the non-bread constituents, faces away from utensil 10. Utensil 10 is placed in the frozen food package in a flat, unfolded form to consume a relatively minor amount of head room. Blank S is formed from a standard material available from such companies as James River Corporation of Richmond, Va. and is standard well known sheet stock used in many packaging applications for microwave reconstitution of food products. By positioning a pizza slice on platform 20, microwave passes through the lower platform into the crust area of the pizza slice. At the same time microwave energy is directed through the top portion of the pizza slice. In use of the utensil so far described, the pizza would become fully cooked and reconstituted without appropriate browning, crisping and other reconstitution of the exposed bread surface at the bottom of the pizza. To accomplish this crisping and browning, in accordance with the invention, a layer 40 formed from a graybody is applied to the lower surface of platform 20. This layer can be coated, laminated, deposited, printed, photographically applied or otherwise applied on the under surface. The layer is a graybody with a absorptivity in a general range of 0.50–0.97. At the higher range, this approaches an ideal blackbody, which is not obtainable.

In accordance with a preferred embodiment of the invention, graybody layer 40 is formed from 3–5 mills of polycarbonate with a black pigment. This produces an absorptivity in the general range of about 0.90 which is on the high range and is essentially considered to be a blackbody. The term "graybody" means that the absorptivity is not 1.0 which is the technical definition of a blackbody and the value against which the resistivity of a graybody is measured. In the preferred embodiment, a graybody approaching a blackbody and having an absorptivity of 0.90 is employed for the layer 40. This is formed from a layer of plastic material having a black pigment which is glued to the underside of platform 20. As shown in FIG. 3, the remainder of the platform 20 is a standard susceptor sheet stock including thin paperboard sheet 100 in a thickness of about 0.30 inches. A thin plastic film 102 has vacuum deposited thereon elemental aluminum forming a microwave reactive stratum 104 coated onto the under surface film 102 and adhered by adhesive to the top surface of paperboard 100. This is a standard paperboard sheet stock S onto which is applied a high absorptivity graybody layer 40 which constitutes improvement of the present invention.

Referring now in more detail to FIG. 3, microwave energy represented by arrows MW passes downwardly through the food item on platform 20 and through sheet stock S. As the microwaves pass through stratum 104, the stratum converts microwave energy into heat causing heat energy schematically illustrated as wavy arrows H to move upwardly into the under surface of the food product being heated. At the same time, heat energy is conducted through paperboard 100 to the graybody layer 40, also referred to as layer GB. Since the absorptivity of layer 40 is extremely high, there is a rapid transfer of heat from stratum 104 to layer 40. This thermodynamic action absorbs the heat and layer 40 becomes a heat sink. This heat sink directs heat through the paperboard to the under surface of the food product. Thus, a rapid and immediate heating of the under surface is accomplished. Heat is not lost from the lower portion of sheet S. The inner face at the upper surface of platform 20 does not exceed about 300° F. However, the substantial amount of heat is transferred across this interface to cause browning and a decrease in entrapped moisture. By using a high absorptivity layer on the under surface of platform 20, a high concentrating of heat transfer is accomplished. There is no loss of heat through paperboard 100. This has proven to create a high browning effect without a high interface temperature. Also, there is no entrapped moisture since the high immediate transfer of energy to the under surface of the food item rapidly drives moisture from between the food item and the platform 20. This can not be accomplished merely by elevated temperature at the interface. All of these phenomenons work in some fashion to maintain relatively low interface temperature while affecting rapid and highly desirable browning and crisping of the under surface of the bread crust. In the past, such browning was accomplished only by increasing the temperature at the interface which is not necessary by using the present invention. Consequently, as will be more fully explained later, the utensil 10 does not have any tendency to degrade the integrity of film 102. Consequently, the utensil can be used more than once and only a single utensil need be supplied in a package having more than one pizza slice.

The radiation blackbody formula is provided in FIG. 3 illustrate that the amount of radiation from the graybody layer 40 is a function of the fourth power of the absolute temperature T. This is the Stefan-Boltzmann law wherein the Stefan-Boltzmann constant ($5.670\times10^{-12}$) is the multiplier of the temperature factor T4. Radiation and absorption are related concepts. A blackbody is an ideal radiator and an ideal heat absorber. As is known, the blackbody radiation relationship is reduced by the absorptivity of a graybody. This is indicated in the lower portion of FIG. 3 where the absorptivity is less than 1.0. The graybody is defined generally as having an absorptivity in the general range of 0.50–0.97 at 300° F. The present invention relates to the use of layer 40 having an absorptivity which is relatively high with respect to the other constituents of sheet stock S. This use of a highly absorptivity layer or coating on the sheet stock controls the temperature at the upper surface adjacent layer 102. It has been found that use of a high absorptivity layer 40 produces a highly satisfactory reconstituted slice of pizza with only the platform type utensil shown in FIGS. 1 and 2.

Figure 4:
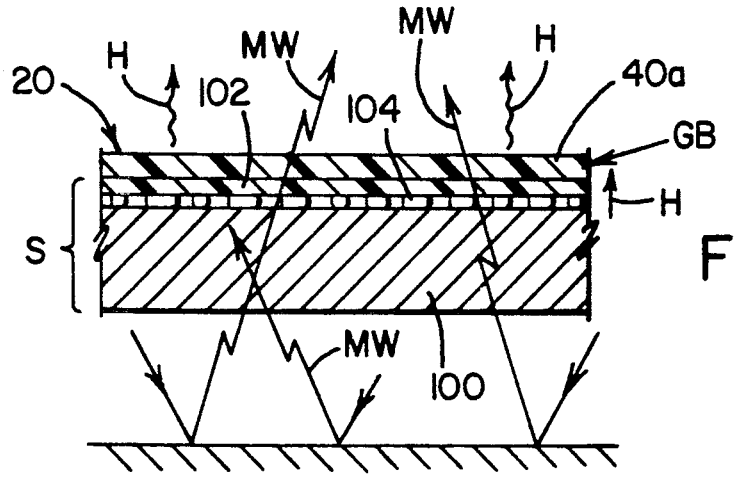
FIG. 4 is an enlarged cross-sectional view similar to FIG. 3 illustrating a modification of the embodiment of the present invention shown in FIG. 3.
Figure 5:
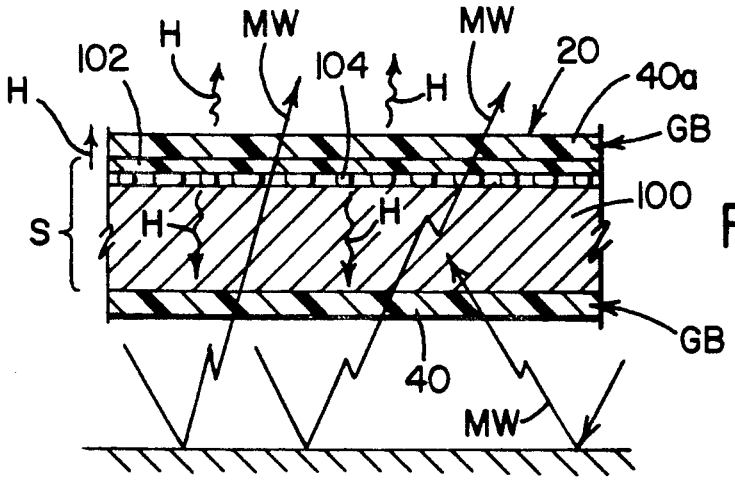
FIG. 5 is a further view similar to FIG. 3 showing still a further modification of the invention.

The modification in FIG. 4 employes graybody surface **40*a* on the upper surface of sheet stock S adjacent film 102. In this instance, heat generated by stratum 104 is directly transferred through layer 40*a* to intensify the heating effect for the food product without increasing the temperature of film 102. In FIG. 5, the modification in FIG. 4 is further changed to include the previously described layer 40 at the lower portion of paperboard 100. In this embodiment, both layers 40, 40*a* absorb energy from microwave interactive stratum 104 to concentrate heat in the under surface of the product being reconstituted on platform 20**.

Figure 6:
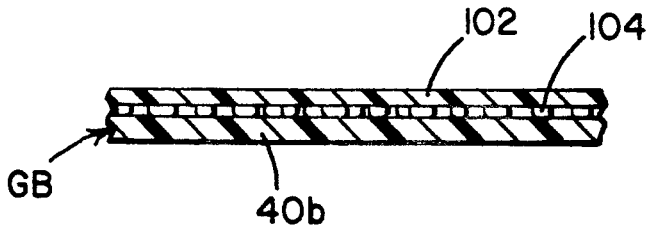
FIGS. 6–9 are enlarged, partial cross-sectioned views of the susceptor sheet showing different positions of the graybody layer.
Figure 7:
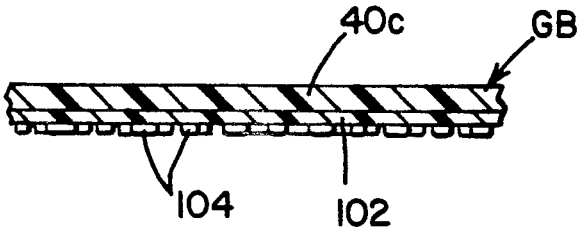
Figure 8:
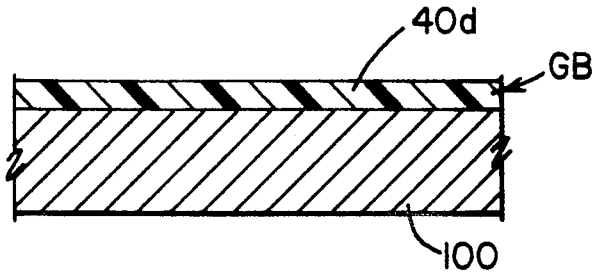
Figure 9:
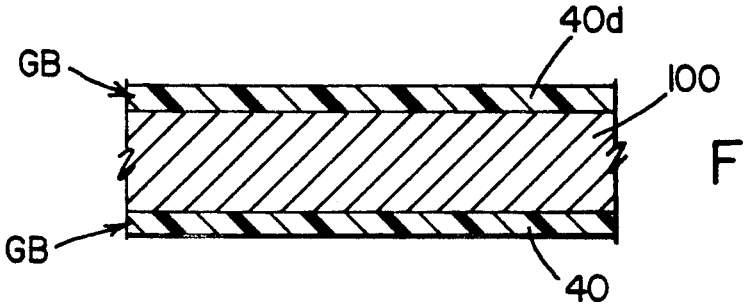

Referring now to FIGS. 6 and 7, the graybody layer GB is applied onto film 102 before it is laminated onto the paperboard 100. In FIG. 6, graybody layer **40*b* is applied by deposition, printing, and/or lamination, onto the aluminum reactive stratum 104. In FIG. 7, the graybody layer 40*c* is applied to the upper surface of film 102. In either instance, this film is then laminated by adhesive to the paperboard 100 for forming a microwave reactive heat susceptor sheet stock. These modifications, especially the modification shown in FIG. 6, illustrates that the graybody layer can be inside sheet S between the two external surfaces of the sheet stock without departing from the invention. FIGS. 8 and 9 show modifications of the invention wherein graybody layer 40*d* is applied to the upper surface of paperboard 100. In FIG. 8, layer 40*d* is captured between the stratum 104 and paperboard 100 as a replacement for lower layer 40. In FIG. 9, both layers 40, 40*d* are applied onto paperboard 100. The application of layer 40 can be either before or after lamination of the microwave reactive layer 104 onto paperboard 100**.

Figure 10:
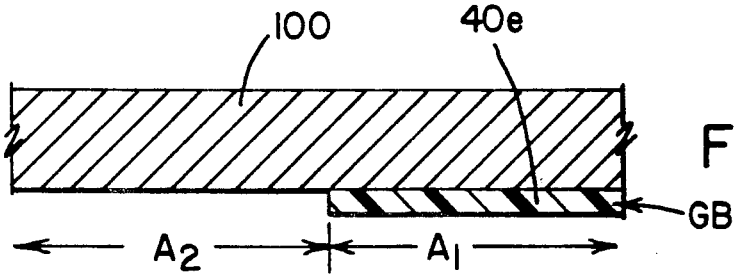
Figure 11:
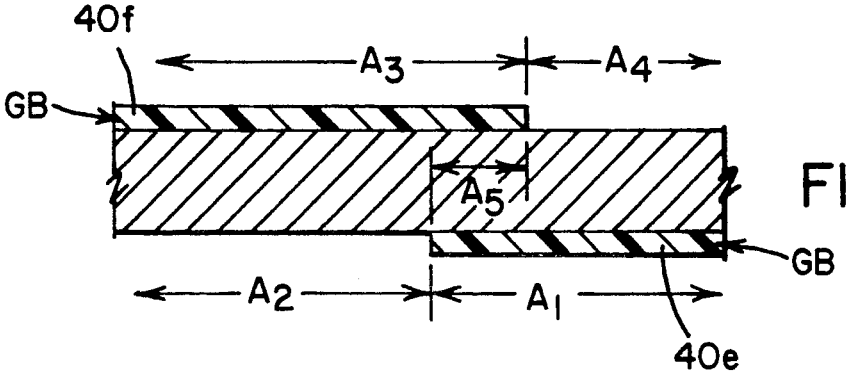

A further modification obtainable by employing the present invention is illustrated in FIGS. 10 and 11 wherein the graybody layer **40*e* is applied to the under surface of paperboard 100. In this instance, layer 40*e* has a preselected area $A_1$ which is distinguished from an area $A_2$ of feed stock S which does not have a coterminous graybody layer. Thus, one portion of the sheet stock ($A_1$) is heated by using the present invention. The other portion of the sheet stock is not modified. By adjusting the areas $A_1$ and $A_2$, a variety of heating relationships can be accomplished by using the present invention. This concept is also shown in FIG. 11 wherein a further partial covering of paperboard 100 is accomplished by upper graybody layer 40*f*. This divides the upper surface of paperboard 100 into area $A_3$, $A_4$, the first of which is subjected to the heat intensifying aspects of the present invention. For illustrative purposes, areas $A_1$ and $A_3$ are illustrated as being overlapping in area $A_5$. Thus, area $A_5$ has the advantages associated with two separate layers of graybody material whereas the other portions $A_2$, $A_4$ subjected only to a single graybody layer. FIGS. 10, 11 are provided to illustrate that several modifications can be made in implementation of the present invention. The areas $A_1$–$A_5$ are the total areas of the heat susceptor sheet even though they are illustrated as applicable only to an association with paperboard 100**.

To illustrate a further possible implementation of the present invention, FIGS. 12 and 13 show areas 120, 120*a* which are not provided with a graybody layer. The other areas of the heat susceptor sheet stock are provided with a graybody layer 110 or blocks 110*a* of graybody material, respectively. In this manner, the amount of heating caused by the graybody layer can be modulated by a pattern and/or the arrangement of the graybody layer to the non-graybody areas of susceptor sheets. The blocks shown in FIG. 13 could be photographically printed in black ink on paperboard 100 or on the upper surface of film 102.

Another cooking utensil or heating utensil applying the present invention is illustrated in FIG. 14 wherein a pot pie dish 200 is provided with an outer layer of surrounding aluminum foil 202. Aluminum foil 202 is reflective and is not permeable to microwave energy. Thus, no microwave heating occurs around the edge of a pot pie in utensil 200. The lower portion of utensil 200 includes an opening in the aluminum foil 202 which is filled with a graybody layer 204. Microwave energy MW passes through this layer into the standard microwave susceptor heat stock S. Thus, a higher heating occurs adjacent the lower surface of the pot pie. This can be employed for the purposes of selective heating and/or browning of a food item within receptacle 200. This receptacle has a round, generally frustoconical shape, which is only representative in nature and is employed for the purposes of illustrating a use of the present invention.

Figure 15:
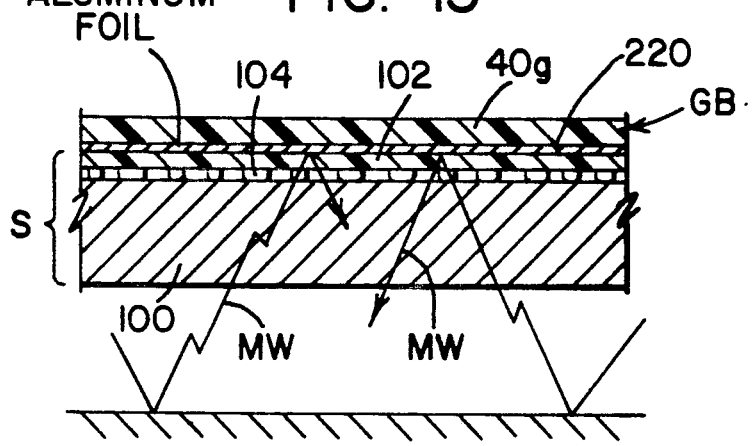
FIG. 15 is an enlarged cross-sectional view illustrating a further modification of the present invention wherein an aluminum reflective layer is employed within the sheet stock.
Figure 16:
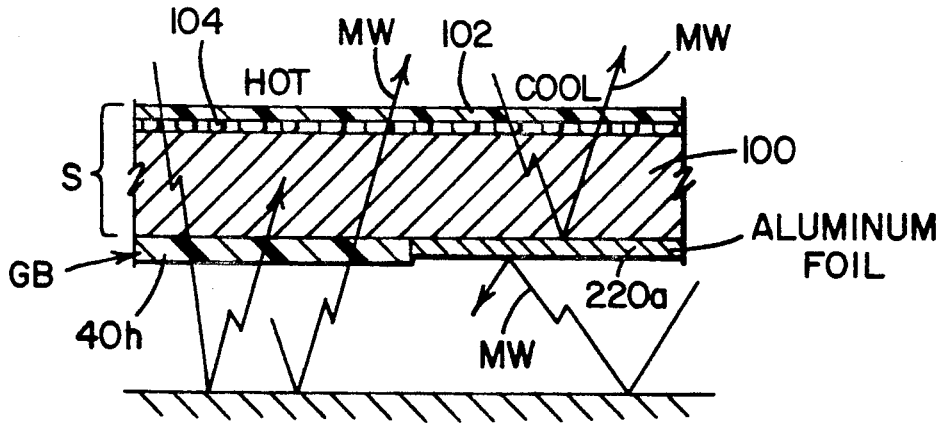
FIG. 16 is an enlarged cross-sectional view showing a further modification of the present invention employing both a combination of a graybody and an aluminum reflective layer; and, FIG. 17 is a flow chart showing a method of using the preferred embodiment of the present invention as illustrated in FIGS. 1 and 2 for reconstituting a number of frozen pizza slices.

A still further way of using the present invention is illustrated schematically in FIGS. 15 and 16. In these illustrations, an aluminum foil is employed for the purposes of creating a reflective layer in combination with the graybody layer. In FIG. 15, the aluminum foil layer 220 is laminated over film 102. Above the aluminum foil is provided graybody layer 40*g*. Thus, as heat energy is created by the double exposure of stratum 104 to the microwave energy MW, a substantial heat energy is created. This heat energy is directed to foil 220 which is a good heat transmitter. Heat is transmitted through the aluminum foil and is absorbed by layer 40*g*. This layer immediately heats the food product. In FIG. 16, aluminum foil 220*a* and graybody layer 40*h* are on different areas of lower surface of sheet stock S. This produces a hot area adjacent the graybody and a cooler area adjacent the aluminum foil 220*a*.

The invention involves a high absorptive layer. It is defined as being microwave permeable. However, this coating or layer, could conceivably, be placed upon a reflective substrate as an aluminum foil as shown in FIG. 15.

Figure 17:
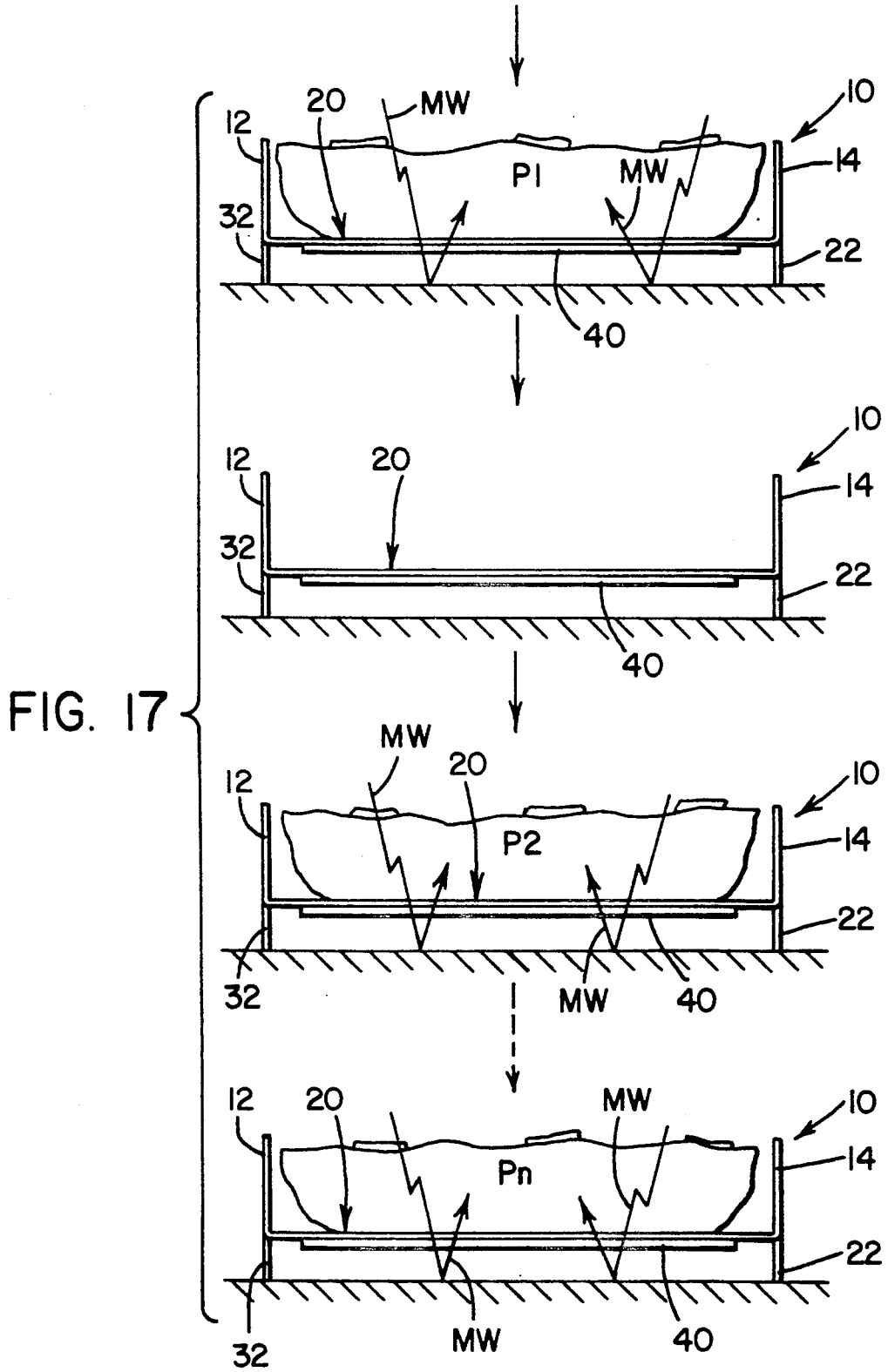

As previously described, it has been found that for various reasons, the use of layer 40 on the under surface of platform 20 allows heating of the pizza slices while providing brown crisp under surface for the bread in contact with the platform 20 without the crazing of film 102. The flow chart shown in FIG. 17 indicates that this advantage of the present invention allows the use of heating utensil 10 more than once for slices P1, P2 and Pn. In this manner, a single utensil or appliance 10 can be supplied in a package having several pizza slices. The same utensil can be used more than once. This is a substantial reduction in the cost of the utensil necessary for reconstituting frozen pizza slices. In addition, by using the invention, the upper portion of utensil 10 is open to allow direct exposure of the pizza with the microwave energy. This is different than a sleeve; however, the invention could be employed with the sleeve of sheet stock S is that is desired.

The present invention has been described with its primary use in reconstituting a frozen food item. There is no intent to limit the invention to that particular application; therefore, the invention can be used in various domestic and industrial heating applications where it is desired to concentrate the heat created by the standard susceptor sheet stock S.

Having thus defined the invention, the following is claimed:

1. In a blankable, foldable microwave reactive heat susceptor sheet stock of the type having two generally parallel surfaces and comprising a thin paper board sheet with a laminated, coterminous reactive layer including a microwave permeable support film with a microwave reactive stratum, the improvement comprising: a gray body layer with an absorptivity over about 0.50 and microwave permeable, said graybody layer being applied coterminously with at least a portion of said parallel surfaces and having an absorptivity value greater than said laminated microwave reactive layer.

2. The improvement as defined in claim 1 wherein said graybody layer is applied onto one of said parallel surfaces.

3. The improvement as defined in claim 1 wherein said graybody layer is applied between said parallel surfaces.

4. The improvement as defined in claim 1 including a second graybody layer with an absorptivity of over about 0.50 applied coterminous with at least a portion of said parallel surfaces.

5. The improvement as defined in claim 1 wherein said absorptivity is in the general range of 0.50–0.97.

6. The improvement as defined in claim 1 wherein said graybody layer comprises a thin sheet laminated with said sheet stock.

7. The improvement as defined in claim 6 wherein said thin sheet includes a surface area and said parallel surfaces have a combined surface area, said surface area of said thin sheet being less than the surface area of said parallel surfaces.

8. The improvement as defined in claim 7 wherein said thin sheet has a preselected surface pattern.

9. The improvement as defined in claim 6 wherein said thin sheet includes a single integral sheet.

10. The improvement as defined in claim 6 wherein said thin laminated sheet is applied to said paperboard sheet.

11. The improvement as defined in claim 1 wherein said graybody layer comprises a thin coating applied to said sheet stock.

12. The improvement as defined in claim 11 wherein said thin coating has a preselected surface pattern.

13. The improvement as defined in claim 11 wherein said coating is applied to said paperboard sheet.

14. The improvement as defined in claim 1 wherein said graybody layer is deposited onto said sheet stock.

15. The improvement as defined in claim 14 wherein said deposited graybody layer comprises a printed layer of graybody material.

16. The improvement as defined in claim 14 wherein said deposited layer includes a preselected deposition pattern.

17. The improvement as defined in claim 14 wherein said graybody layer is deposited onto said paperboard.

18. The improvement as defined in claim 1 wherein said sheet stock is in the form of a blank to be formed into a heating utensil.

19. The improvement as defined in claim 1 wherein said graybody absorptivity value is greater than the absorptivity value of said paperboard sheet.

20. In a heating utensil formed from a blank of microwave reactive heat susceptor sheet stock of the type having two generally parallel surfaces and comprising a thin paperboard sheet with a laminated, coterminous, microwave reactive layer including a microwave permeable support film with a microwave reactive stratum, the improvement comprising: a graybody layer with an absorptivity over above 0.50 and microwave permeable, said graybody layer having an absorptivity value greater than said laminated microwave reactive layer and applied coterminously with at least a portion of said parallel surfaces.

21. The heating utensil as defined in claim 20 wherein said graybody layer is applied onto one of said parallel surfaces.

22. The heating utensil as defined in claim 20 wherein said graybody layer is applied between said parallel surfaces.

23. The heating utensil as defined in claim 20 wherein said absorptivity is in the general range of 0.50–0.97.

24. The improvement as defined in claim 20 wherein said graybody layer comprises a thin sheet laminated with said sheet stock.

25. The heating utensil as defined in claim 24 wherein said thin sheet includes a single integral sheet.

26. The heating utensil as defined in claim 24 wherein said thin laminated sheet is applied to said paperboard sheet.

27. The heating utensil as defined in claim 20 wherein said graybody layer comprises a thin coating applied to said sheet stock.

28. The heating utensil as defined in claim 20 wherein said graybody layer is deposited onto said sheet stock.

29. The heating utensil as defined in claim 28 wherein said deposited graybody layer comprises a printed layer of graybody material.

30. The heating utensil as defined in claim 28 wherein said deposited layer includes a preselected deposition pattern.

31. The heating utensil as defined in claim 20 wherein said graybody absorptivity value is greater than the absorptivity value of said paperboard sheet.

32. A heating utensil for a food product, said utensil formed from a microwave reactive heat susceptor sheet stock of the type having two generally parallel surfaces and comprising a thin paperboard sheet with a laminated, coterminous microwave reactive layer including a microwave permeable support film with a microwave reactive stratum, said utensil having a lower, generally flat food supporting portion and a graybody applied to said supporting portion, said graybody layer having an absorptivity over about 0.50 and microwave permeable, said graybody absorptivity value being greater than the absorptivity value of said laminated microwave reactive layer, and said graybody layer being coterminous with at least a portion of said supporting portion of said susceptor sheet stock.

33. A heating utensil as defined in claim 32 wherein said graybody layer is applied onto one of said parallel surfaces.

34. A heating utensil as defined in claim 32 wherein said graybody layer is applied between said parallel surfaces 35. A heating utensil as defined in claim 32 including a second graybody layer with an absorptivity of over about 0.50 and microwave permeable, said second graybody layer being applied coterminous with at least a portion of said parallel surfaces at said lower supporting portion.

36. A heating utensil as defined in claim 32 wherein said absorptivity is in the general range of 0.50–0.97.

37. A heating utensil as defined in claim 32 wherein said graybody layer comprises a thin sheet laminated with said sheet stock at said lower supporting portion.

38. A heating utensil as defined in claim 37 wherein said thin sheet includes a surface area and said lower supporting portion have a surface area, said surface area of said thin sheet being less that the surface area of said lower supporting portion.

39. A heating utensil as defined in claim 38 wherein said thin sheet has a preselected surface pattern.

40. A heating utensil as defined in claim 37 wherein said thin laminated sheet is applied to said paperboard sheet at said lower portion.

41. The improvement as defined in claim 32 wherein said graybody layer comprises a thin coating applied to said sheet stock at said lower supporting portion.

42. A heating utensil as defined in claim 41 wherein said coating is applied to said paperboard sheet at said lower portion.

43. A heating utensil as defined in claim 32 wherein said graybody layer is deposited onto said sheet stock.

44. The heating utensil as defined in claim 32 wherein said graybody absorptivity value is greater than the absorptivity value of said paperboard sheet.

* * * * *